US009618256B2

(12) United States Patent
Tippmann

(10) Patent No.: US 9,618,256 B2
(45) **Date of Patent: *Apr. 11, 2017**

(54) SWING SEAL FOR A RACK-AISLE FREEZING AND CHILLING SYSTEM

(71) Applicant: Tippmann Companies LLC, Fort Wayne, IN (US)

(72) Inventor: Daniel J. Tippmann, Fort Wayne, IN (US)

(73) Assignee: Tippmann Companies Inc., Fort Wayne, IN (US)

( * ) Notice: Subject to any disclaimer, the term of this patent is extended or adjusted under 35 U.S.C. 154(b) by 176 days.

This patent is subject to a terminal disclaimer.

(21) Appl. No.: 14/550,092

(22) Filed: Nov. 21, 2014

(65) Prior Publication Data

US 2015/0075193 A1 Mar. 19, 2015

Related U.S. Application Data

(63) Continuation of application No. 13/074,098, filed on Mar. 29, 2011, now Pat. No. 8,919,142.

(51) Int. Cl.

| | |
|---|---|
| ***F25D 13/00*** | (2006.01) |
| ***F25D 17/00*** | (2006.01) |
| ***F25D 17/04*** | (2006.01) |
| ***F25D 17/06*** | (2006.01) |

(52) U.S. Cl.

CPC ..... *F25D 13/00* (2013.01); *F25D 17/005* (2013.01); *F25D 17/04* (2013.01); *F25D 17/06* (2013.01); *F25D 2500/02* (2013.01)

(58) Field of Classification Search

CPC ..... F25D 13/00; F25D 17/04; F25D 17/06; F25D 17/005

See application file for complete search history.

(56) References Cited

U.S. PATENT DOCUMENTS

| | | | | |
|---|---|---|---|---|
| 2,778,206 | A | 1/1957 | Wilson et al. | |
| 3,479,947 | A | 11/1969 | Myers | |
| 3,545,223 | A | 12/1970 | Elland | |
| 3,621,672 | A * | 11/1971 | Meredith | F25D 17/06 62/237 |
| 3,638,450 | A | 2/1972 | Falk | |
| 4,221,421 | A | 9/1980 | Bettker, Jr. et al. | |

(Continued)

FOREIGN PATENT DOCUMENTS

| | | |
|---|---|---|
| FR | 2 871 222 | 12/2005 |
| WO | 2005/106356 | 11/2005 |
| WO | 2007/122334 | 11/2007 |

*Primary Examiner* — Emmanuel Duke

(74) *Attorney, Agent, or Firm* — Faegre Baker Daniels LLP

(57) ABSTRACT

An automatically adjustable swing seal for a rack-aisle freezing and chilling system extends, for example, from the top horizontal frame member of a racking structure and defines an intake opening along with side seals and a bottom seal. The swing seal is positioned at a height such that a product stack having a top edge positioned at any point along the face of the swing seat creates a seal between the intake opening and the stack via the swing seal, the side seals, and the bottom seal. Thus, stacks of varying heights may automatically be accommodated. Further, the bottom edge of the swing seal may be beveled, such that if a product stack is not evenly stacked a portion of the uneven stacking will not catch against the swing seal when the stack is pulled away from the opening.

19 Claims, 17 Drawing Sheets

(56) References Cited

U.S. PATENT DOCUMENTS

| | | | | |
|---|---|---|---|---|
| 4,425,768 | A | 1/1984 | Burns | |
| 4,474,020 | A | 10/1984 | Freeman | |
| 4,934,255 | A | 6/1990 | McDonnell et al. | |
| 5,353,564 | A | 10/1994 | Hansen | |
| 5,497,698 | A * | 3/1996 | Bolkestein | A23L 3/3418 99/467 |
| 5,575,714 | A | 11/1996 | Rijs | |
| 5,706,662 | A | 1/1998 | Van | |
| 5,778,557 | A | 7/1998 | Leavens | |
| 6,340,043 | B1 | 1/2002 | Paupardin | |
| 6,446,452 | B2 | 9/2002 | Durham | |
| 6,901,768 | B1 * | 6/2005 | Windecker | F25D 17/045 62/239 |
| 7,752,867 | B2 | 7/2010 | Lehmann et al. | |
| 7,832,218 | B2 | 11/2010 | Hawkins | |
| 8,459,180 | B2 | 6/2013 | Paupardin et al. | |
| 2011/0107784 | A1 | 5/2011 | Tippmann et al. | |

* cited by examiner

SWING SEAL FOR A RACK-AISLE FREEZING AND CHILLING SYSTEM

CROSS-REFERENCE TO RELATED APPLICATION

This application is a continuation of U.S. patent application Ser. No. 13/074,098 filed Mar. 29, 2011, the entire disclosure of which is hereby explicitly incorporated by reference herein.

BACKGROUND

1. Field of Invention

The present invention relates to a warehouse or structure that mass freezes and stores bulk foods and other products, and in particular to racking and chilling structures in the warehouse.

2. Description of Related Art

Two-stage freezer warehouses are known in which large pallets of items including meats, fruit, vegetables, prepared foods, and the like are frozen in blast rooms of a warehouse and then are moved to a storage part of the warehouse to be maintained at a frozen temperature until their removal. Such two-stage freezer warehouses require separate blast and storage rooms that encompass a relatively large amount of space.

U.S. patent application Ser. No. 12/877,392 entitled "Rack Aisle Freezing System for Palletized Product", filed on Sep. 8, 2010, relates to an improved system for freezing food products. Shown in FIG. 1 is a large warehouse 2 that is used to freeze and maintain perishable foods or like products. Large pallets of items, including meats, fruits, vegetables, prepared foods, and the like, are sent to warehouse 2 to be frozen employing a system whereby the palletized foods are frozen on storage racks.

FIG. 2 shows a top view of the interior of warehouse 2, in which rows of palleted product are shown such that pallets 4 abut chambers 6. As shown in FIG. 3, rows of racking 14 are positioned between aisles 10 and chambers 6. Each chamber 6 is enclosed by a pair of end walls 15 and top panel 17. Cold air produced in warehouse 2 is drawn through spacers 20 (FIGS. 5 and 6) separating rows of cases 22 of product on pallets 4, creating a palletized product stack which is disposed and sealed against the exterior of racking 14 (FIG. 3) via forklifts 18.

Chillers 8 (FIG. 2) provided in the interior of warehouse 2 produce the cold air and maintain the temperature of ambient air within the warehouse space at a level below freezing. A plurality of racking structures 14 (FIGS. 3 and 4) each define a plurality of adjacent air flow chambers 6 (FIGS. 2 and 4) having air intake openings on opposite sides thereof and a plurality of air outlets having air moving devices, such as exhaust fans 12, on top panels 17, which causes freezing air to be drawn into chambers 6 through intake openings and to then exhaust into the warehouse space. The plurality of airflow chambers 6 are each defined by a pair of end walls 15 and top wall 17 having one or more air outlets and exhaust fans associated therewith (FIG. 3). Pallets 4 on pallet guides are pressed against the intake openings such that a seal is formed between the pallets and the intake openings via side periphery seals, a bottom periphery seal, and atop periphery seal that is selectively adjustable via a vertically manually adjustable bracket to which the top periphery seal attaches. The seals together define each intake opening. Freezing air is drawn through air pathways 16 (FIGS. 2, 4, and 5) within the palletized product in a direction towards chamber 6 to thereby quickly freeze the product. As shown in FIG. 5, spacers 20 may be placed between rows of cases 22 of product to provide air pathways 24 through which air flow can enter chamber 6.

While the top periphery seal may be adjusted via the corresponding bracket, a manual adjustment is required before product stacks of varying heights my be disposed against the intake openings such that a seal is formed between the stacks and openings. What is desired is an improvement over the foregoing.

SUMMARY

The present disclosure provides an automatically adjustable swing seal that for the rack-aisle freezing and chilling system described above extends, for example, from the top horizontal frame member of a racking structure and defines an intake opening along with side seals and a bottom seal. The swing seal is positioned at a height such that a product stack having a top edge positioned at any point along the face of the swing seal creates a seal between the intake opening and the stack via the swing seal, the side seals, and the bottom seal. Thus, stacks of varying heights may automatically be accommodated. Further, the bottom edge of the swing seal may be beveled, such that if a product a stack is not evenly stacked, a portion of the uneven stacking will not catch against the swing seal when the stack is pulled away from the opening.

In one form thereof, the present disclosure provides an installation for chilling or freezing and cold storage of product stacks of palletized product, including a cold storage warehouse space, at least one chiller in the warehouse space that produces chilled or freezing air and maintains the temperature of ambient air in the warehouse space at chilled or below freezing, at least one air flow chamber including opposite walls, a plurality of air intake openings in at least one wall of the walls, and at least one air outlet having an associated air moving device for causing chilled or freezing air to be drawn into the chamber through the air intake openings and exhausted into the warehouse space through the air outlet, and swing seals disposed over respective air intake openings, each swing seal hingedly connected to the one wall via a hinge defining a horizontal axis about which the swing seal rotates. When stacks of product to be chilled or frozen are disposed in sealing engagement with the air intake openings against the swing seals, a top edge of each engaged product stack is disposed against a front panel of the swine seal to rotate the swing seal inward about said horizontal axis of the hinge such that the swing seal and peripheral walls defining the air intake opening create a seal between the engaged product stack and the air intake opening, and chilled or freezing air is drawn through the product stack to thereby quickly freeze the product.

In another form thereof, the present disclosure provides an installation for chilling or freezing and cold storage of palletized product, including a cold storage warehouse space, at least one chiller in the warehouse space that produces chilled or freezing air and maintains the temperature of ambient air in the warehouse space at chilled or below freezing, at least one air flow chamber including opposite walls, a plurality of air intake openings in at least one wall of the walls, and at least one air outlet having an associated air moving device for causing chilled or freezing air to be drawn into the chamber through the intake openings and exhausted into the warehouse space through the air outlet, and swing seals disposed over respective air intake openings, the swing seals extending forwardly of their respective air intake openings and being yieldably movable rearwardly toward the interior of the chamber. When product stacks to be frozen or chilled are disposed in sealing engagement with the air intake openings against the swing seals, the swing seals are pushed inwardly such that the swing seal and peripheral walls defining the air intake opening create a seal between the engaged product stack and the air intake opening, and chilled or freezing air is drawn through the product stack to thereby quickly freeze the product.

In yet another form thereof, the present disclosure provides an installation for chilling or freezing and cold storage of stacks of palletized product, the installation including a cold warehouse space cooled by a chiller and a chamber having a plurality of air intake openings in a wall thereof, a method for chilling or freezing the stacks of palletized product, including providing a swing seal over each of a plurality of intake openings, the seals extending forwardly of the respective openings and being yieldably movable rearwardly toward an interior of the chamber; moving a stack of palletized product against the periphery of one of the openings thereby contacting the respective swine seal and pushing the swing seal rearwardly such that the product stack is scaled against the periphery of the opening and the swing seal; and drawing chilled or freezing air through the product stack into the chamber and out of the chamber to thereby chill or freeze the product stack.

BRIEF DESCRIPTION OF THE DRAWINGS

The above-mentioned and other features and advantages of this disclosure, and the manner of attaining them, will become more apparent and the invention itself will be better understood by reference to the following descriptions of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the disclosure in any manner.

DETAILED DESCRIPTION

Figure 1:
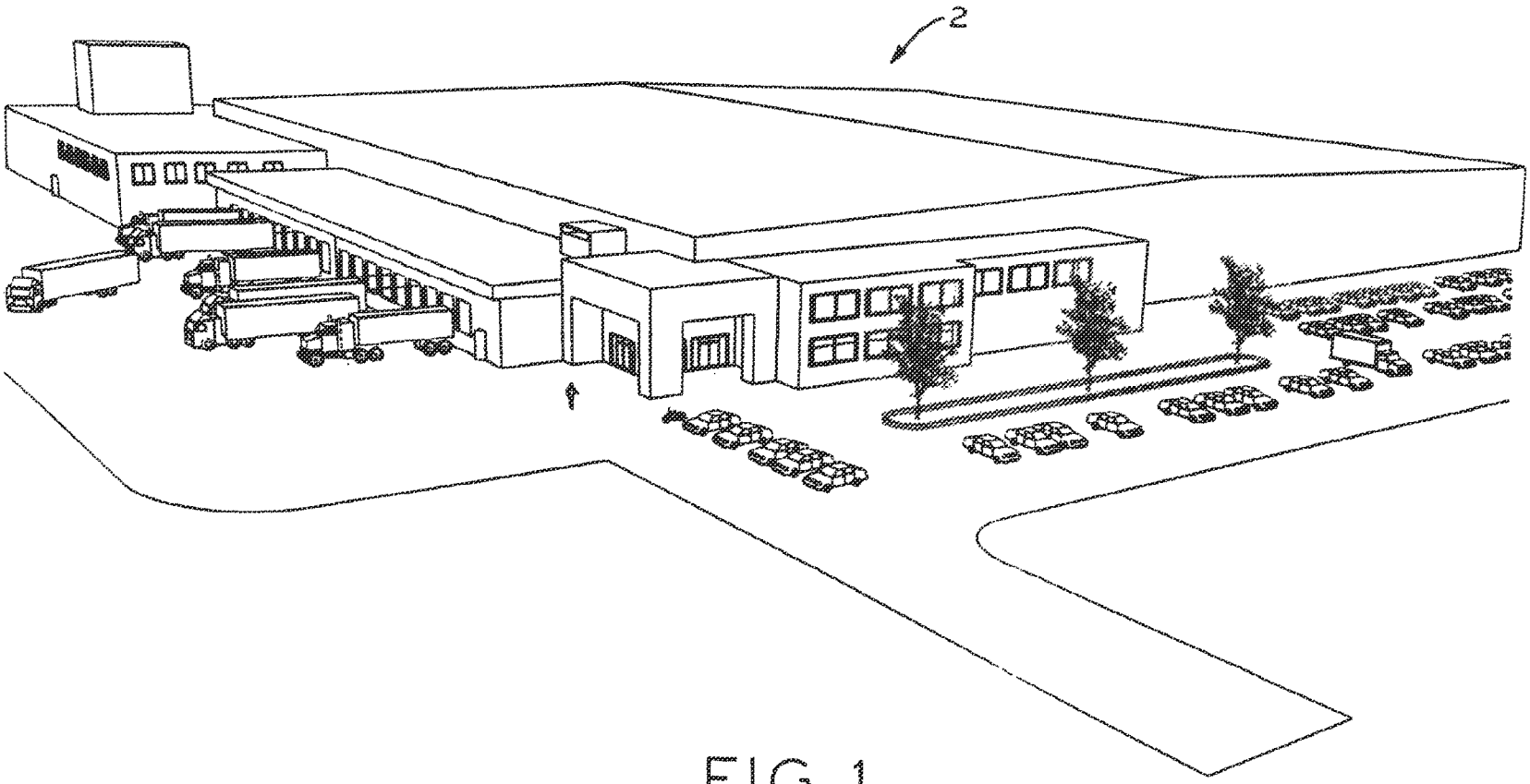
FIG. 1 is a perspective view of a warehouse incorporating a freezing system in accordance with the present disclosure.

An improved sealing system for an installation and method for chilling or freezing and cold storage of palletized product is disclosed herein. A chiller 8 provided in the interior of a cold storage warehouse 2 is used to maintain the temperature of ambient air within the space of the warehouse at a low level such as below freezing. A plurality of racking structures 14 each define a plurality of air flow chambers 6 each having walls with air intake openings on opposite sides thereof and an air outlet and fan 12 to enable freezing air to be drawn into the chamber through intake openings and exhausting into the warehouse space.

Figure 6:
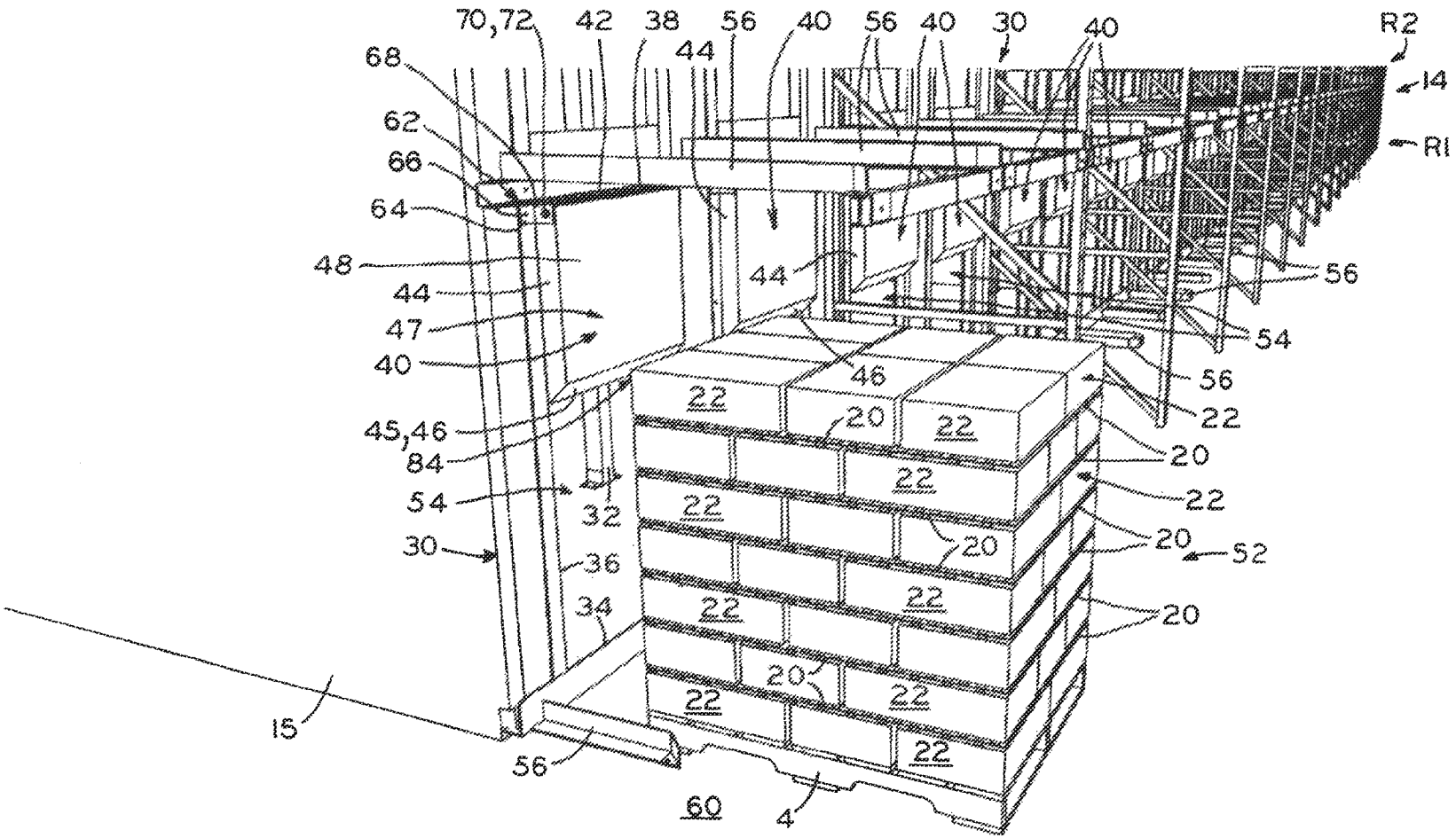
FIG. 6 shows loading of the palletized product into the racks.
Figure 9:
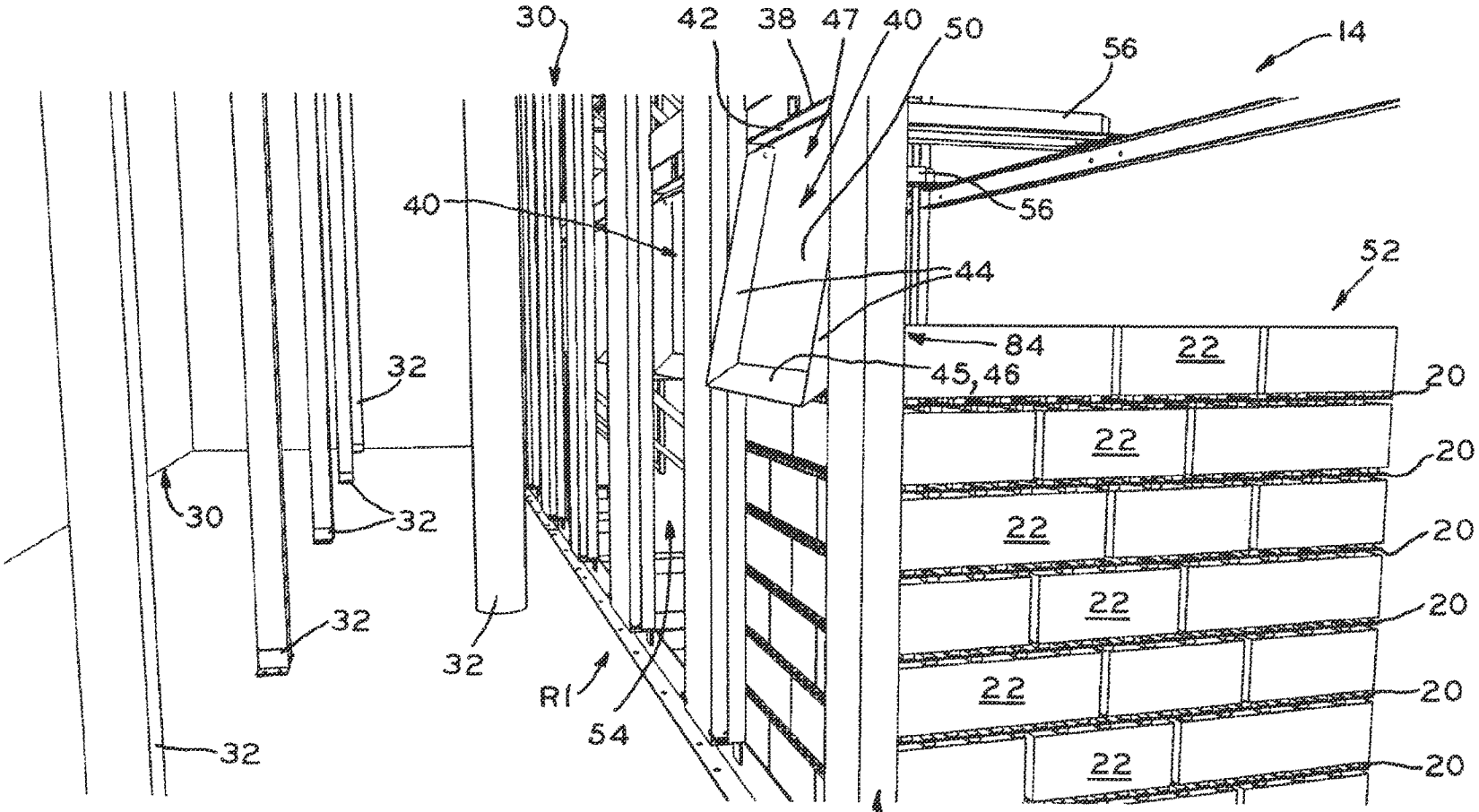
FIG. 9 is a perspective view of the racking structure with the palletized product disposed against the swing seal of FIG. 7 as seen from the interior air chamber.

As further described below, palletized product stacks 52 on pallet guides 56 are pressed against the intake openings 54 such that a seal is formed between the palletized product stacks and the intake openings via side periphery seals, a bottom periphery seal, and an automatically adjustable top periphery swing seal, the seals together defining each intake opening 54. Chilling or freezing air is drawn through air pathways within the palletized product in a direction towards the chamber to thereby quickly freeze the product, which may then advantageously be stored on the same rack on which it is frozen. Referring to FIG. 6, racking structure 14 includes wall 30, which is one of a pair of walls 30 defining the exterior of racking structure 14. End walls 15 are disposed between the pair of walls 30 on opposite ends of racking structure 14. End walls 15, walls 30, and top panels 17 having exhaust fans 12 define interior chambers 6. Referring to FIG. 9, chambers 6 may include posts 32 of racking structure 14 to provide stabilizing support to the structure.

Walls 30 are formed by interconnected vertical and horizontal steel frame members which may define a plurality of openings. Referring to FIG. 6, each wall 30 of racking structure 14 includes bottom horizontal frame member 34 forming a lower seal, vertical frame members 36 that form a pair of side periphery seals 36, and top horizontal frame member 38. Frame members 34, 36, and 38 are preferably made of steel having flat faces but elastomeric material could be fastened to the front faces if desired. When product stack 52 is not disposed against wall 30, as shown in FIG. 6, swing seals 40 (described below), frame members/seals 34 and bottom horizontal frame member 34 define a series of intake openings 54 spaced along wall 30 of racking structure 14.

Support guides 56 assist to position product stacks 52 within separate bays along racking structure 14 and against individual bay intake openings 54 of wall 30. The product stacks described herein may be loaded along the empty bays of first row R1 and/or second row R2. Additional rows above the first and second rows for racking structure 14 are within the scope of this disclosure and may additionally include bays into which product stacks may be positioned and disposed against respective intake openings. Product stacks are positioned against empty bays having bay intake openings other either side of racking structure 14, such that each intake opening of racking structure 14 is covered by a product stack. Filler panels (not shown) are utilized to cover any intake openings against which a product stack is not disposed to create and maintain a sufficient negative pressure environment within internal chamber 6.

A product stack 52 may be disposed against an intake opening 54 of a wall 30 and pressed against a front panel 47 of a swing seal 40, as described below, at a level corresponding to the height of the product stack, such that product stacks of varying heights may be utilized with the swing seal described herein without requiring a manual adjustment of the swing seal for such varying product stacks. As further described below, the product stack 52 presses against and rotates the swing seal 40 inwardly towards chamber 6 until the product stack abuts the frame members 34, 36 of the wall and a seal is created between the product stack and the intake opening.

Swing seal 40 is disposed below top horizontal frame member 38 of wall 30. The swing seal may be made of a steel sheet, although other materials such as elastomeric materials may be used in desired. Swing seal 40 includes top panel 42, a pair of side panels 44 and bottom panel 45, which forms beveled bottom edge 46. Top panel 42, side panels 44, and bottom panel 45 of swing seal 40 are disposed around the periphery of front panel 47. Interior face 50 (FIG. 9) of front panel 47 faces towards the direction of chamber 6 and exterior face 48 (FIG. 6) of front panel 47 faces toward the product stack to be loaded. Further, side panels 44 define a thickness. When swing seal 40 is in an at rest position such that a product stack is not disposed against swing seal 40, face 48 of front panel 47 protrudes forwardly from wall 30 at a distance corresponding to or less than the thickness of side panels 44.

Figure 7:
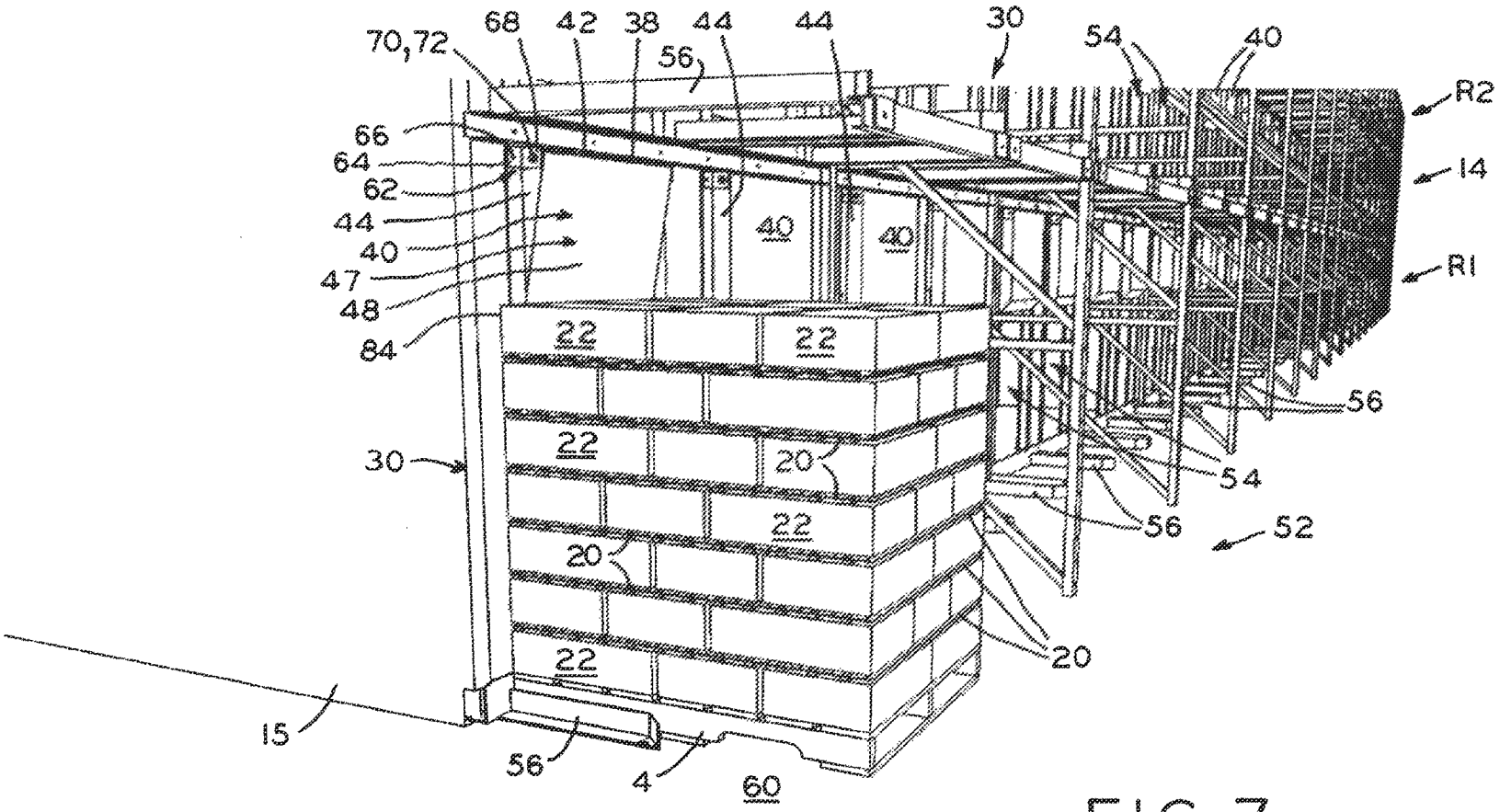
FIG. 7 shows the palletized product loaded into the racks and disposed against a swing seal of the racking.

Referring to FIG. 7, when product stack 52 is disposed against intake opening 54 of wall 30, swing seal 40 yieldably moves by pivoting rearwardly towards an interior of chamber 6 via rotating about a horizontal axis from a rest position to a seal position. Alternative designs of the swing seal may yieldably move rearwardly towards the interior of chamber 6 along a horizontal plane and, for example, against a spring biased three. In the seal position, as further described below, swing seal 40, the pair of side periphery seals 36, and bottom horizontal frame member 34 defining the lower seal create the seal between product stack 52 and intake opening 54.

Figure 10:
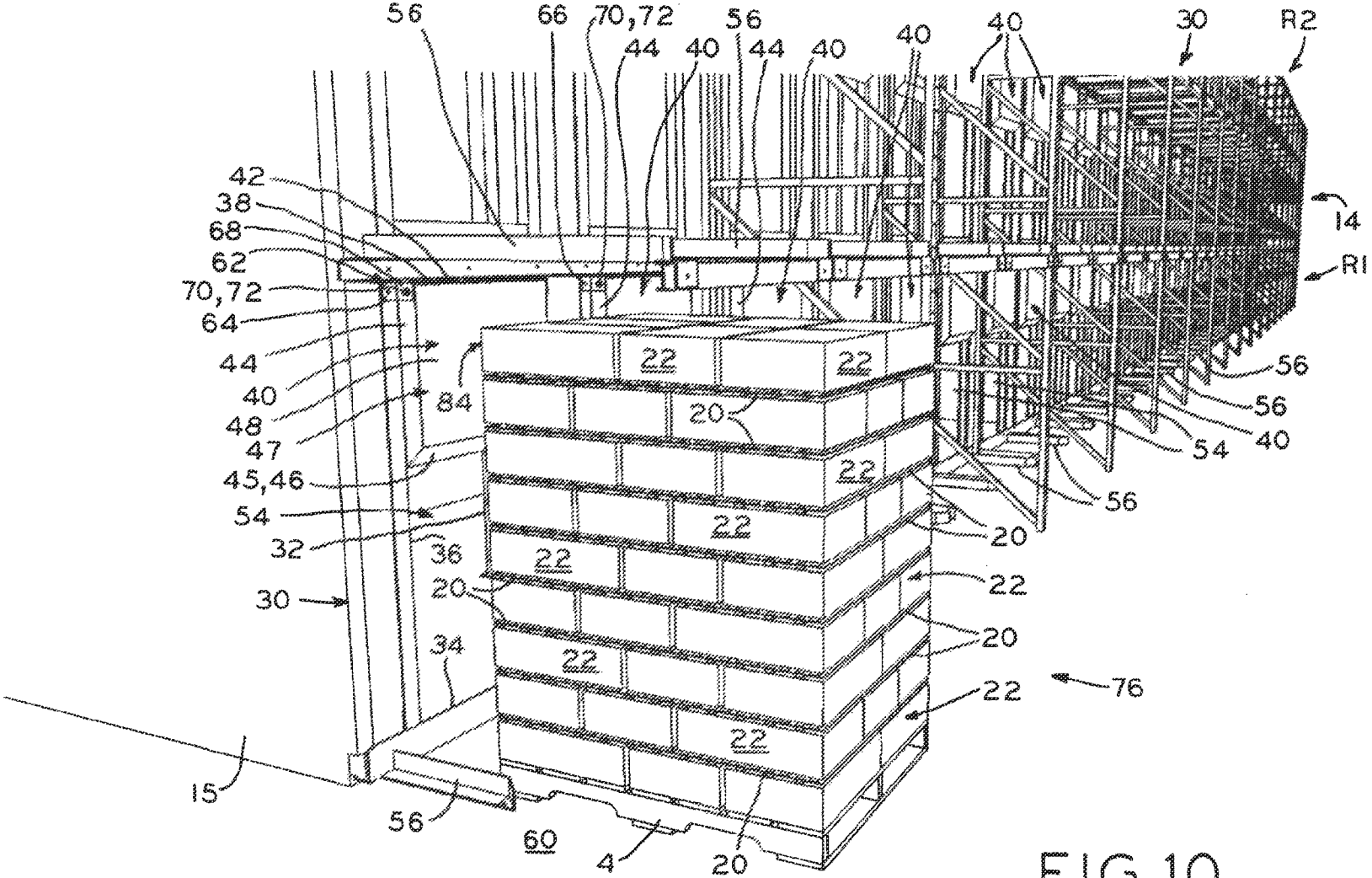
FIG. 10 shows loading of palletized product of an alternative height into the racks.

As mentioned above, the product stacks may vary in height, as shown by the different product stacks of FIGS. 6 and 10. For example, to cooperate with the swing seal of the present disclosure, the product stack may have a height ranging from a first height measured from floor 60 to just above bottom panel 45 of swing seal 40 to a second height measured from floor 60 to near the top portion of exterior face 48 of swing seal 40 that is at brackets 62 supporting swing seal 40, as discussed further below.

Figure 17:
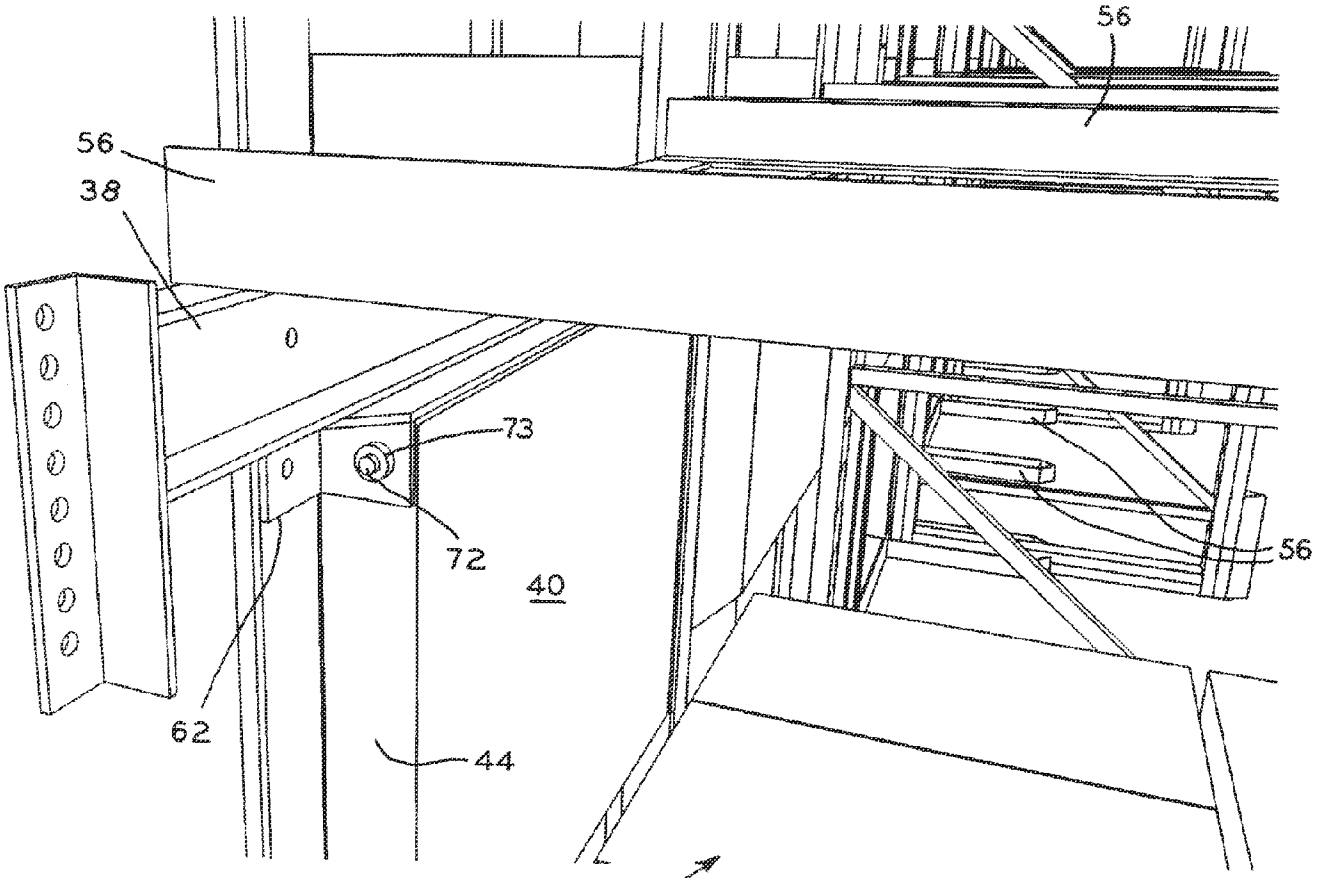
FIG. 17 is an enlarged perspective view showing the support for the swing seal.

The side panels 44 of swing seal 40 are attached to vertical frame members 36 of wall 30 via a pair of L-shaped brackets 62 such that swing seal 40 is rotatable about a horizontal axis, as described further below. Each bracket 62 includes legs 64 and 68. Leg 64 is attached to an upper portion of frame member 36 via a fastener, such as a bolt, that extends through aperture 66 of leg 64. Leg 68 is attached to an upper portion of side panel 44 of swing seal 40. Side panels 44 each include a rod aperture for receipt of rod 72. A hinge such as rod 72 extends through the pair of L-shaped brackets 52 and side panels 44 of swing seal 40 such that swing seal 40 can rotate about a horizontal pivot axis defined by rod 72. Particularly, rod 72 extends through the rod apertures of swing seal 40 and apertures 70 of legs 68 of brackets 62 on either side of swing seal 40 and is retained in place by means of a pair of locking collars 73 fastened to rod 72 by set screws (not shown) as shown in FIG. 17. As rod 72 defines the horizontal axis, swing seal 40 may rotate about the horizontal axis inwards towards chamber 6.

Figure 8:
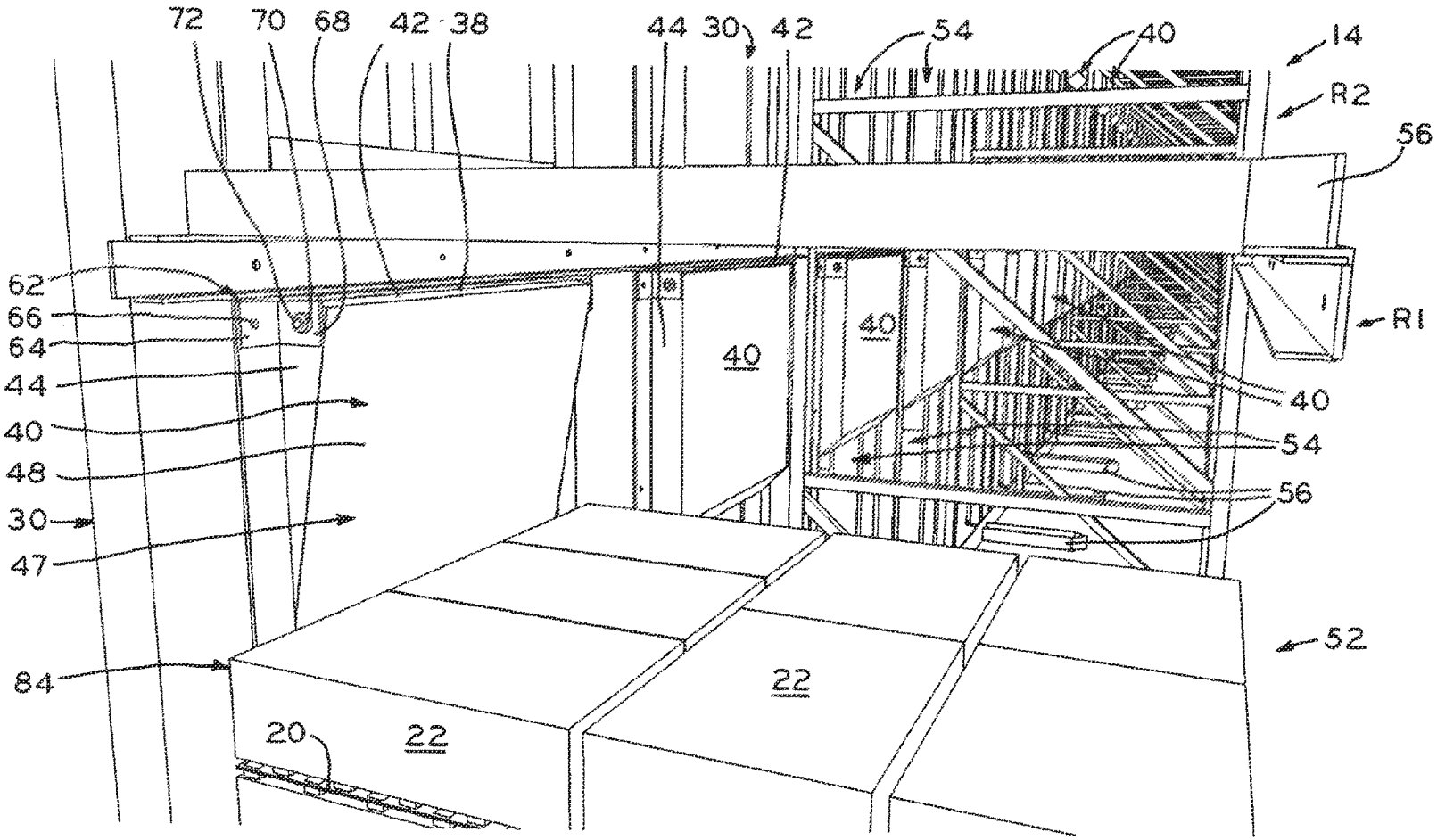
FIG. 8 is an enlarged fragmentary view showing the palletized product disposed against the swing seal of FIG. 7.

Referring to FIG. 7, as product stack 52 is placed or disposed against opening 54 as described above, a top corner of product stack 52 is pressed against face 48 of swing seal 40 (FIG. 8) to move swing seal 40 from the rest position to the seal position. Referring to FIG. 8, swing seal 40 is rotated about a horizontal axis of rod 72 (FIG. 9) until product stack 52 abuts side periphery seals 36 and lower seal 34 of wall 30, at which point swing seal 40 is in the seal position. In the seal position, the area of exterior face 48 of swing seal 40 seals against the top edge 84 of product stack 52. Exterior face 48 along with side panels 44 of swing seal 40 and seals 36 and 34 restrict the passage of air to chamber 6 outside of air being directed through spacers between cases on the product stack 52, as described below.

Figure 2:
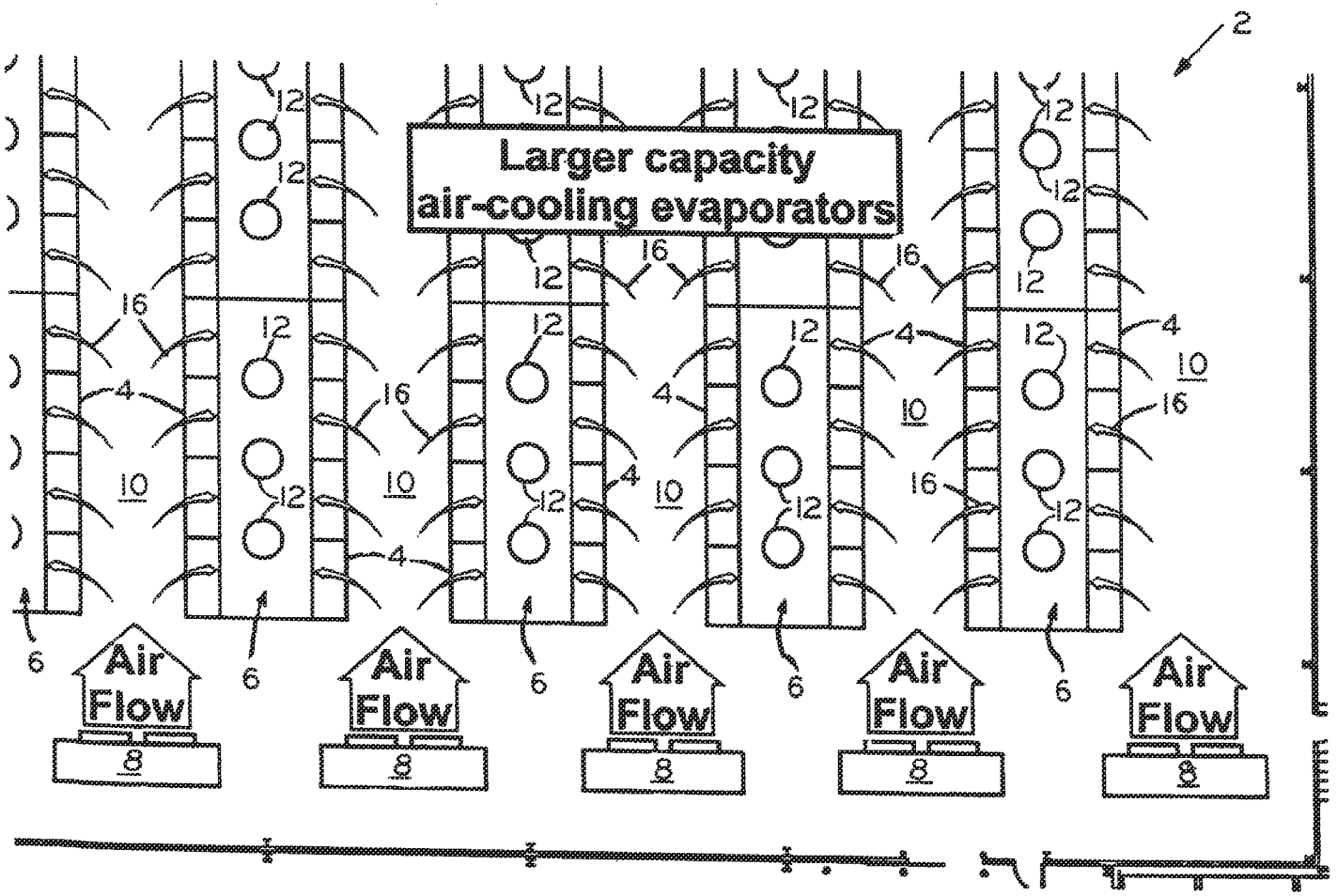
FIG. 2 is a diagrammatic top view of a freezer warehouse incorporating the system of the present disclosure.
Figure 3:
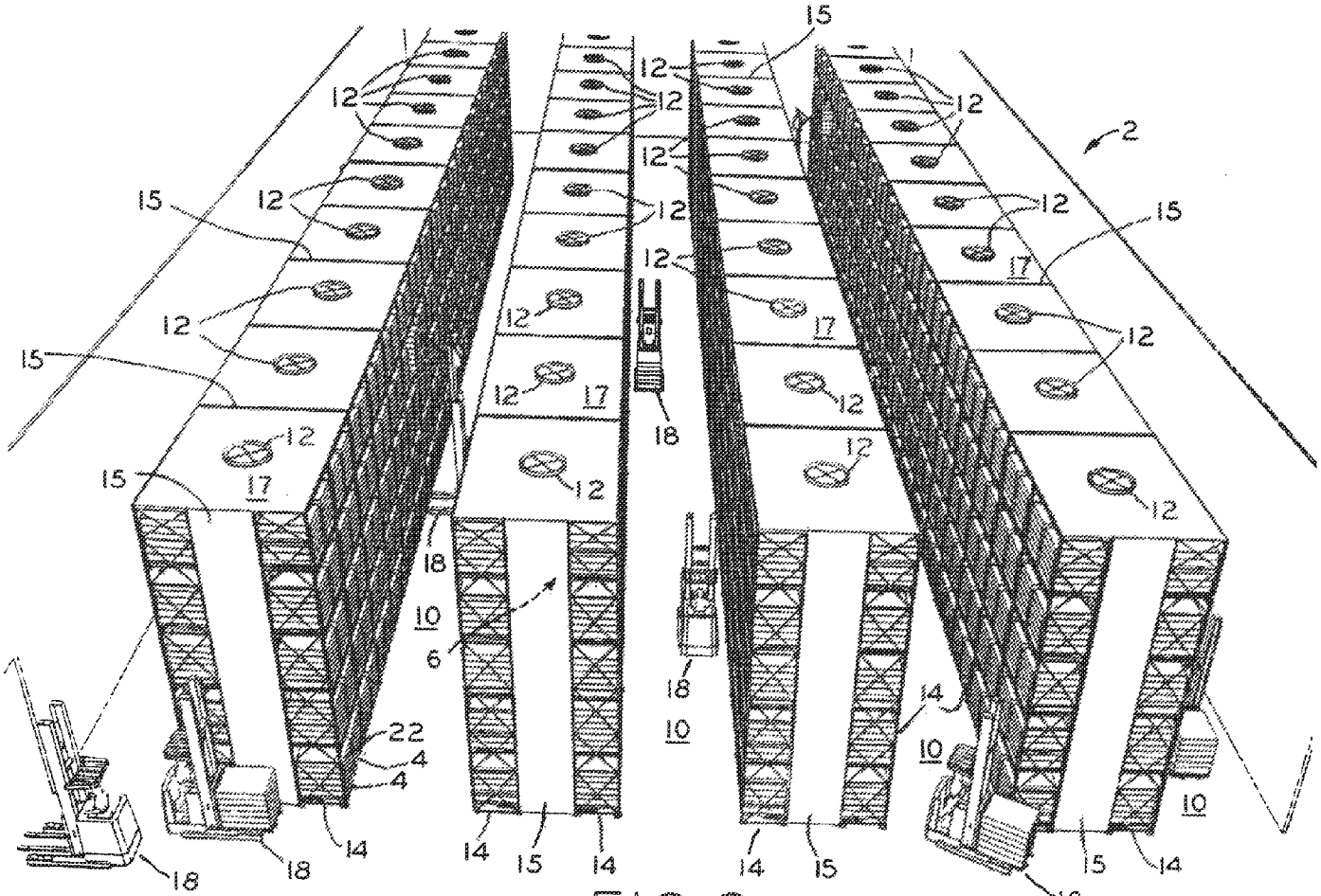
FIG. 3 is a perspective view of the interior of the freezer warehouse.
Figure 4:
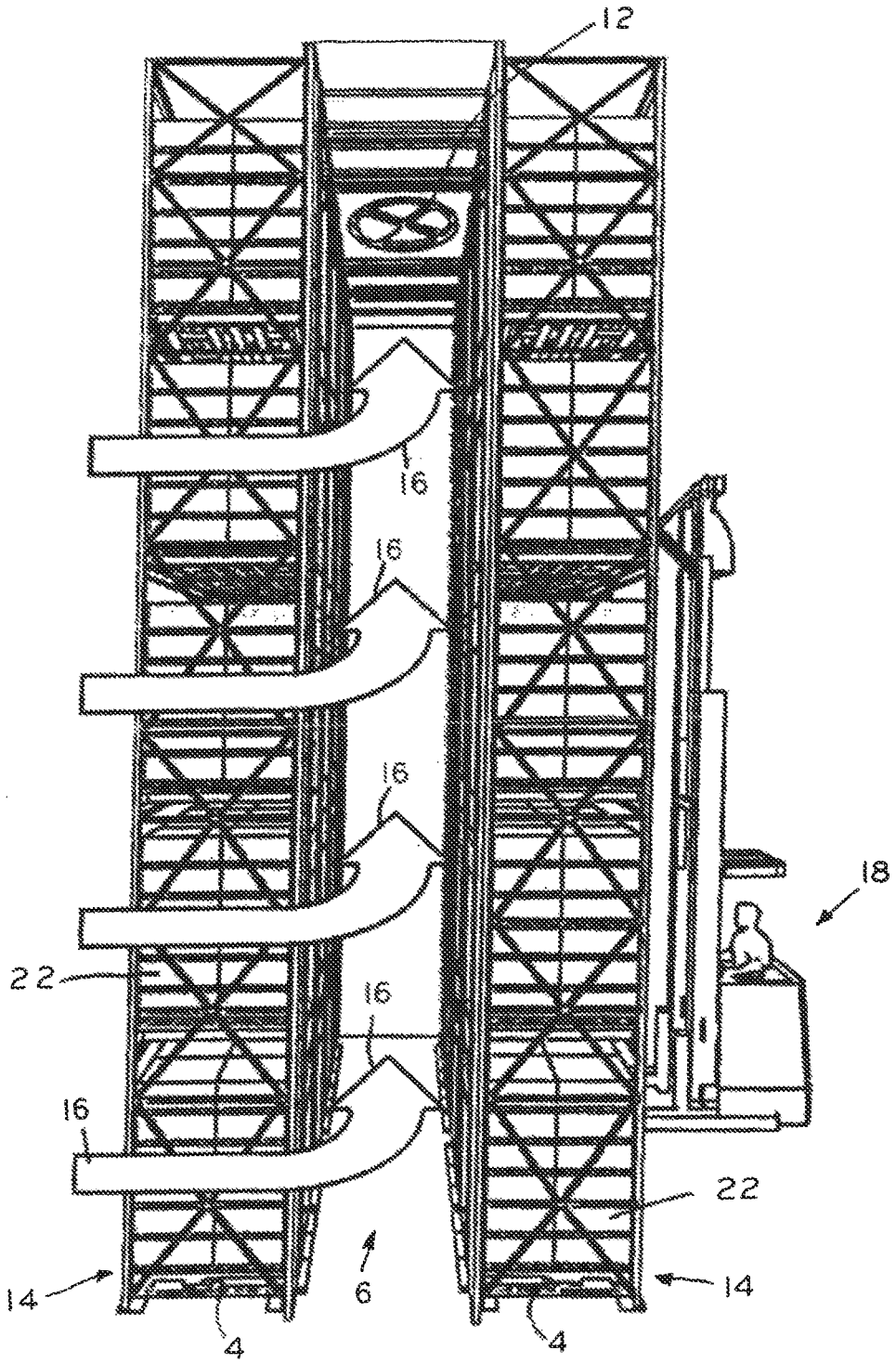
FIG. 4 is a perspective end view of two rows of racking.
Figure 5:
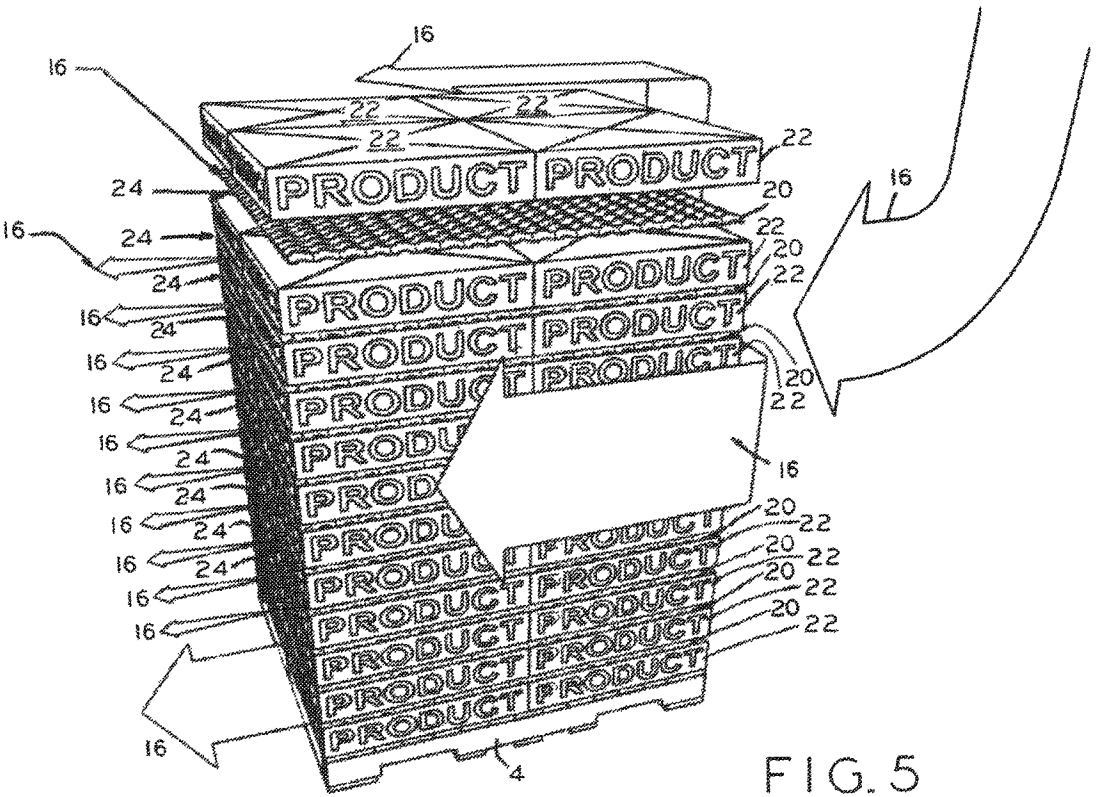
FIG. 5 is a diagrammatic perspective view showing the flow of chilling air through the palletized product.

Referring back to FIG. 7, chilled air is drawn into chamber 6 via product stack 52. Product stack 52 includes cases 22 positioned on pallet 4. Cases 22 are separated by spacers 20 such that, when product stack 52 is placed or disposed against wall 30, air is drawn through spacers 20 (FIG. 5), and/or through openings in the product boxes 22, through intake opening 54 (FIG. 6) into chamber 6 and exhausted through chamber 6 via exhaust openings such as fans 12 within top panel 17. The air drawn through spacers 20 is chilled sub-freezing air circulated by chillers 8 (FIG. 2). The chilled air is capable of freezing product of product stack 52 when drawn through spacers 20 and maintaining the product at the frozen temperature.

Figure 11:
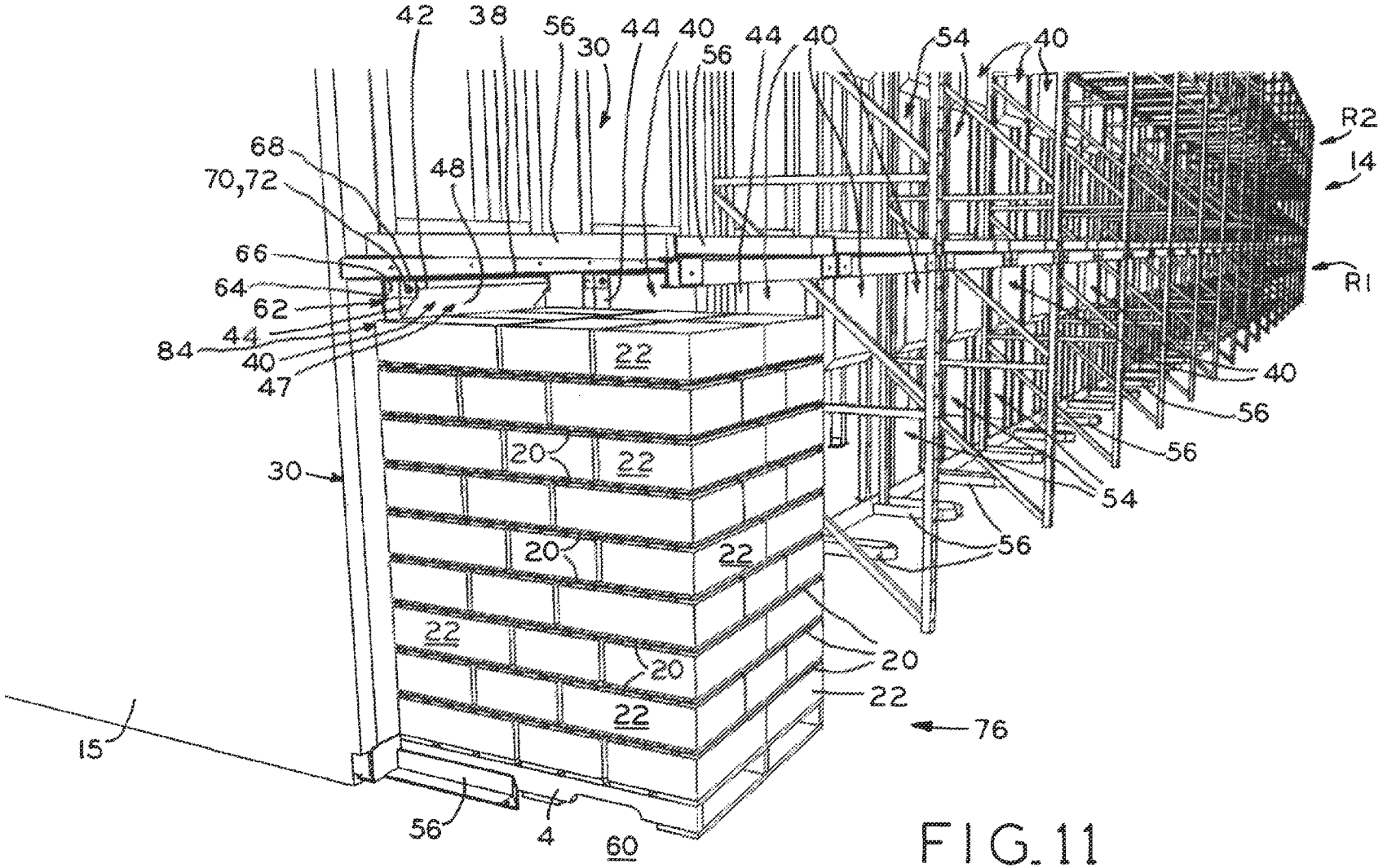
FIG. 11 shows the palletized product of FIG. 10 loaded into the racks and disposed against a swing seal of the racking.
Figure 12:
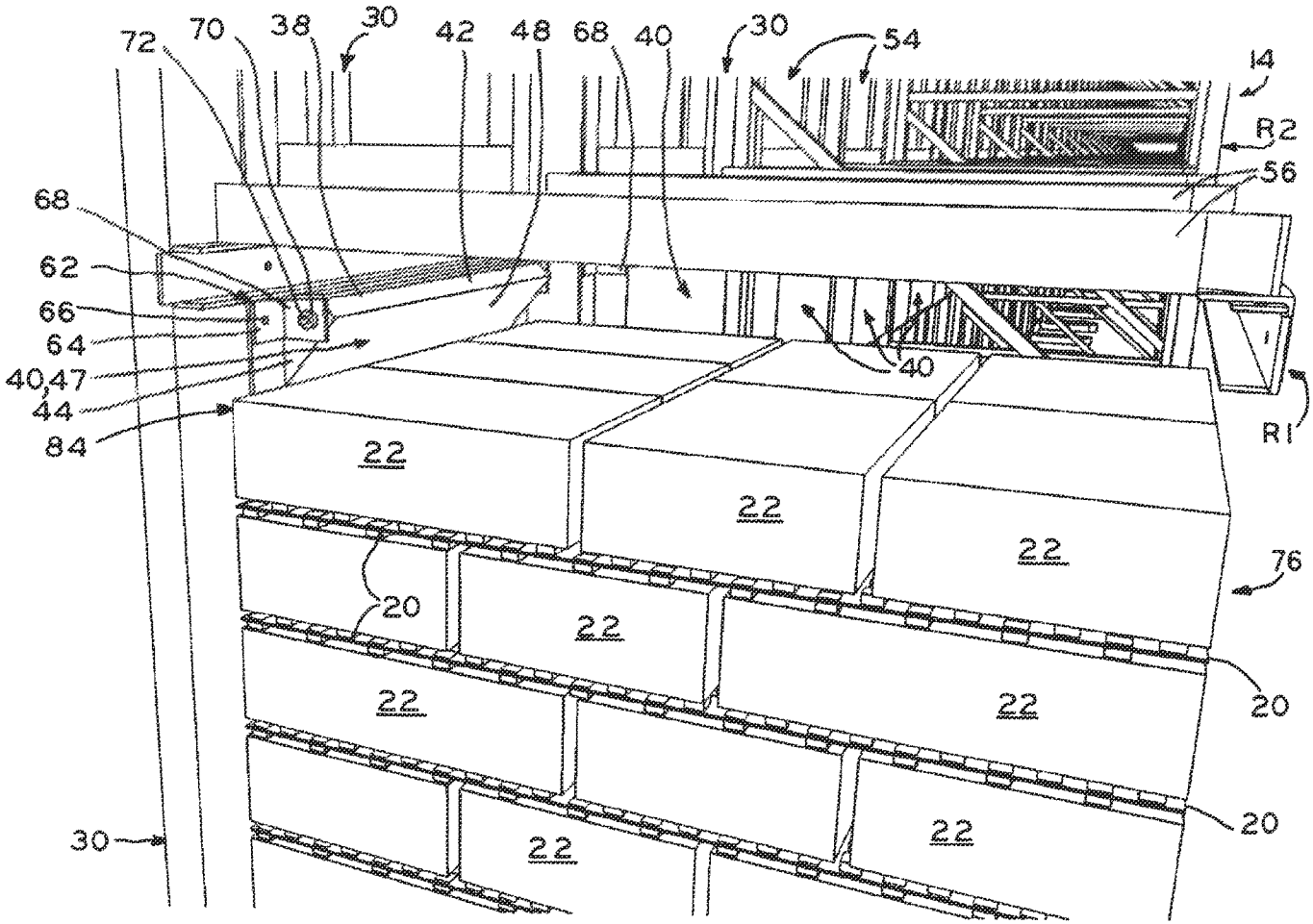
FIG. 12 is a fragmentary view showing the palletized product disposed against the swing seal of FIG. 11.
Figure 13:
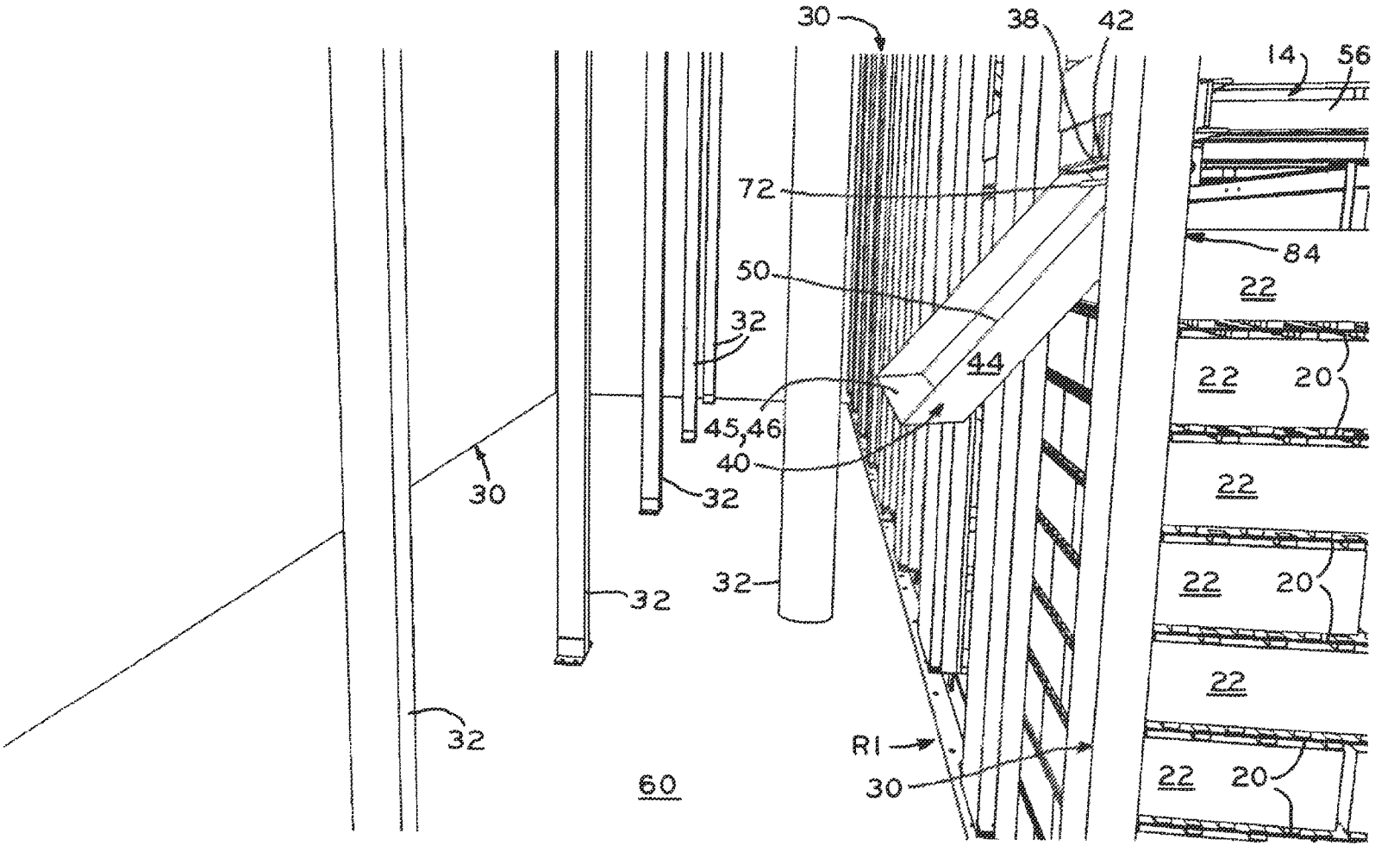
FIG. 13 is a perspective view of the racking structure with the palletized product of FIG. 10 disposed against the swing seal of FIG. 11 as seen from the interior air chamber.

FIGS. 10-13 show the method described above of positioning a product stack against intake opening 54 with product stack 76 having an alternative height that is higher than product stack 52 shown in FIGS. 6-9. Referring to FIG. 11, as product stack 76 is placed or disposed against wall 30 as described above, a top edge 84 of product stack 76 presses against face 48 of swing seal 40. Swing seal 40 is then rotated about a horizontal axis defined by rod 72 inwards towards chamber 6 to a sealed position, as described above (FIG. 13).

Figure 14:
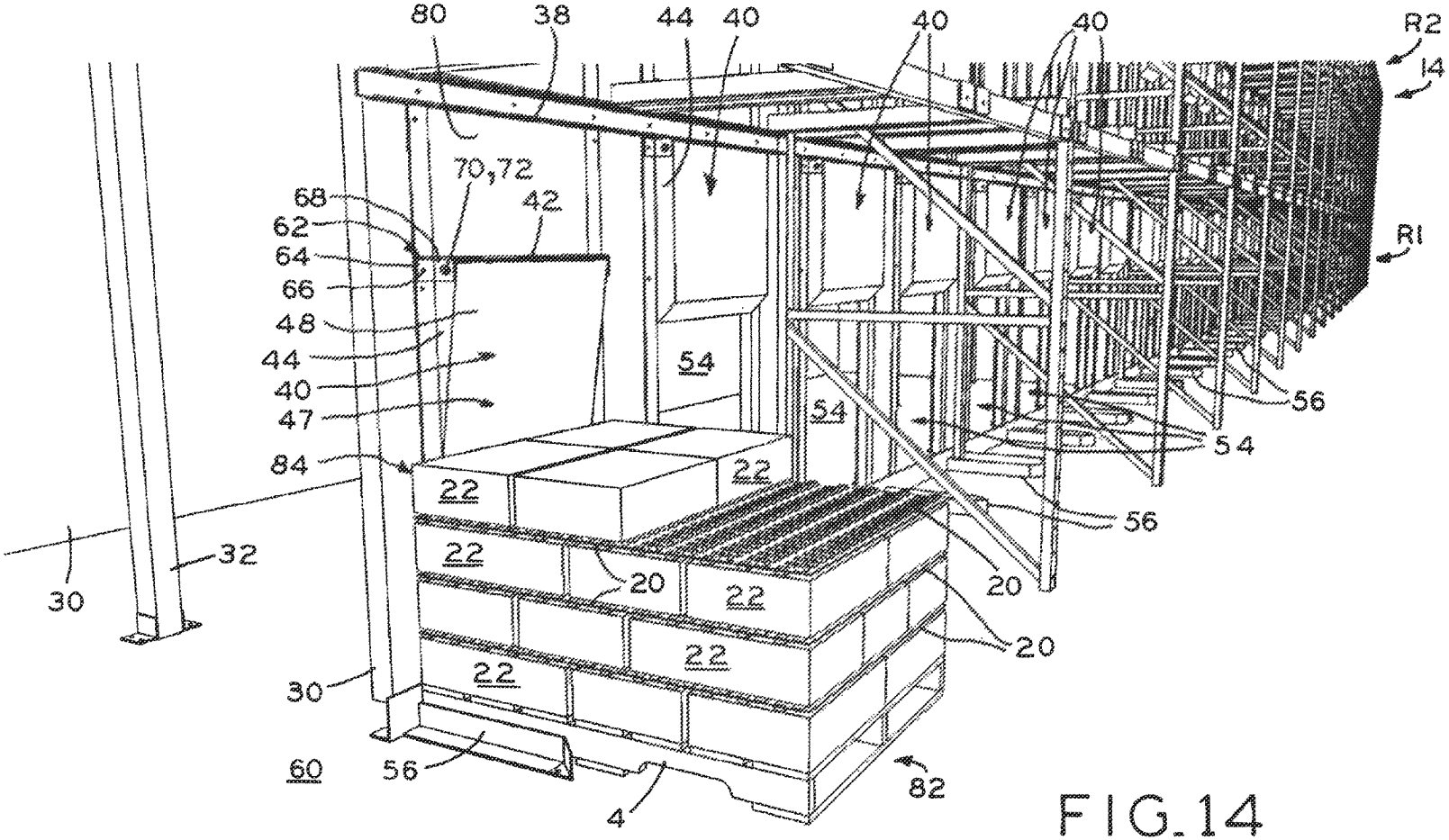
FIG. 14 shows palletized product of an another alternative height loaded into the racks and disposed against a swing seal of the racking, the swing seat disposed beneath a filler panel that seals a portion of an opening of the racking.
Figure 15:
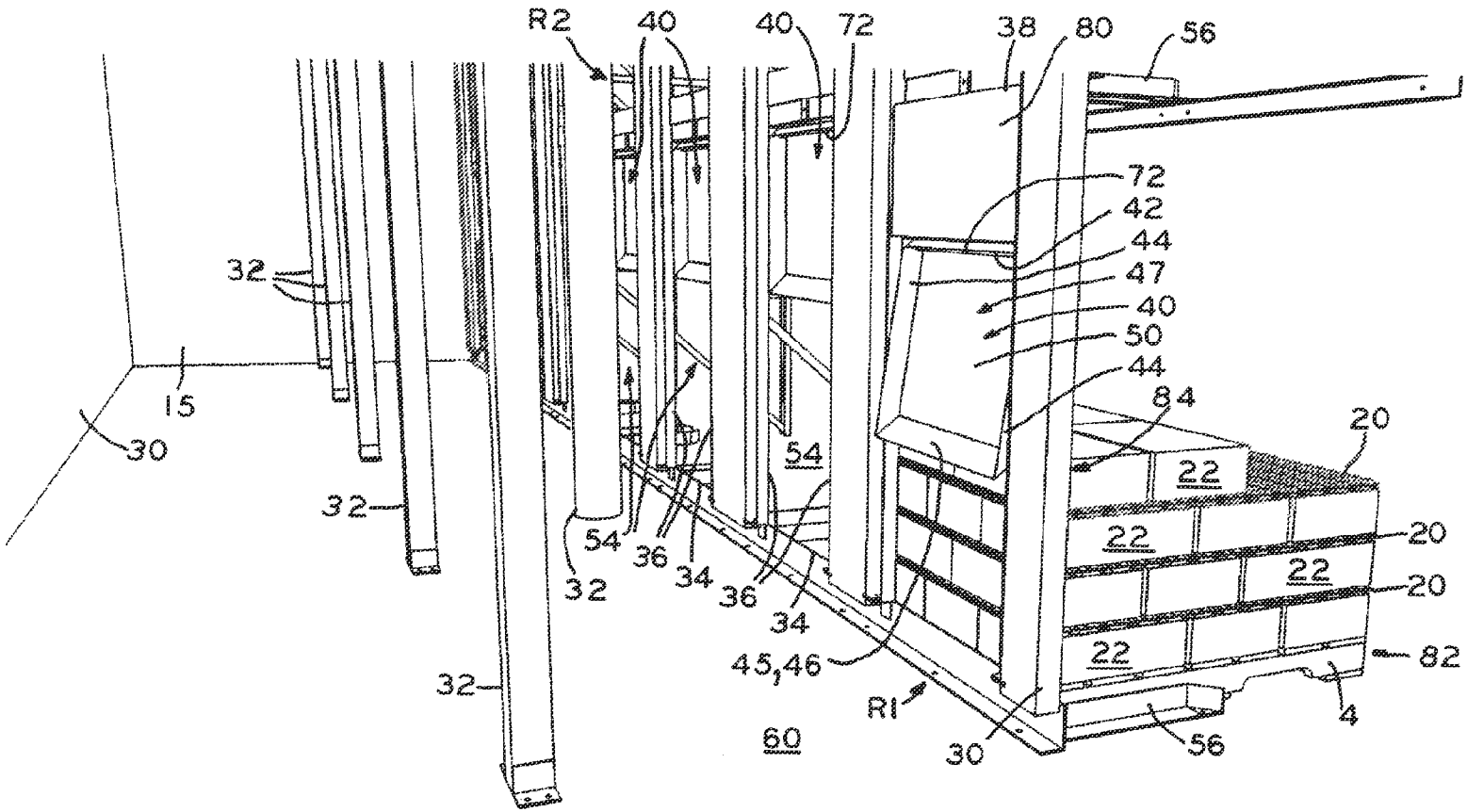
FIG. 15 is a perspective view of the racking structure with the palletized product of FIG. 14 disposed against the swing seal of FIG. 14 as seen from the interior air chamber.
Figure 16:
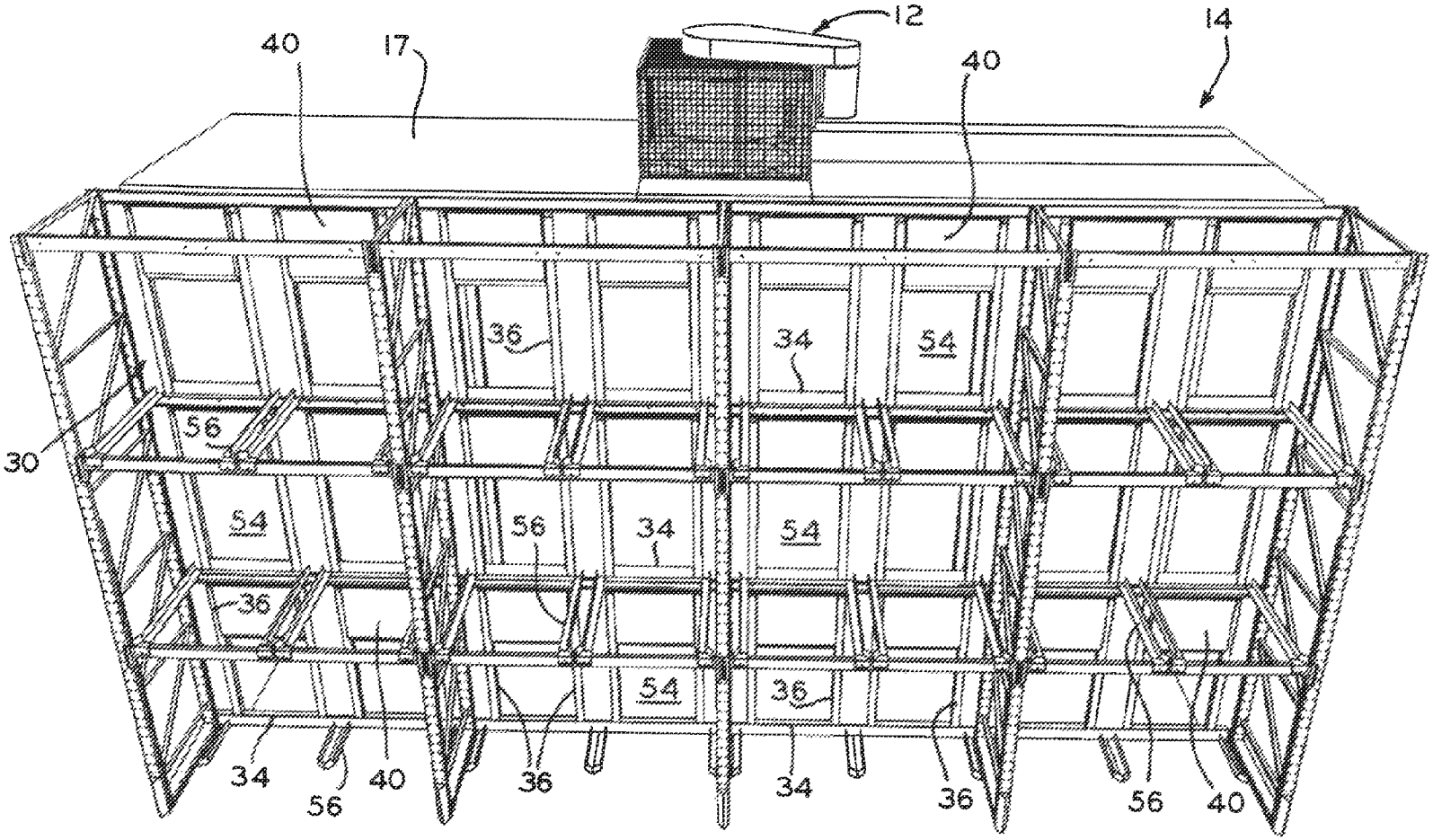
FIG. 16 is a perspective view of a portion of the racking structure accommodating twenty-four pallets on each side thereof.

Referring to FIGS. 14-15, a product stack may be positioned at a level below bottom panel 45 of swing seal 40. In such situations, as shown in FIG. 14, filler panel 80 is attached below top horizontal frame member 38 of wall 30 such that it is disposed between top horizontal frame member 38 of wall 30 and top panel 42 of swing seal 40 to restrict any undesired passage of air into chamber 6. Brackets 62 are attached to side periphery seals 36 below filler panel 80, and swing seal 40 is attached to wall 30 via brackets 62, in the manner described above. Product stack 82 of FIGS. 14 and 15 is then at a height such that a top edge 84 of product stack 82 may interact with swing seal 40 to rotate swing seal 40 inwards towards chamber 6 (FIG. 15), as described above, creating a seal between product stack 82 and the intake opening.

Further, in the described embodiments, bottom panel 45 of swing seal 40 forms an obtuse angle with front panel 47 to form beveled bottom edge 46. The beveled edge 46 reduces the chance that the lower edge of the swing seal 40 catches onto a product stack when the stack is being pulled back from the intake opening, or being positioned against the intake opening. Beveled bottom edge 46 prevents a product stack from getting caught or hung up onto the bottom panel of the swing seal when the product stack is being pulled back from intake opening 54.

Further, if product stack 76 has a height such that top edge 84 is at a height level with beveled bottom edge 46 of swing seal 40, top edge 84 can seal against beveled bottom edge 46. This allows for a greater sealable range based on product stack height than if the bottom edge were perpendicular to front panel 47.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An installation for warehousing palletized product, comprising:

a pallet racking assembly comprising:

a pallet receiving space sized and configured to receive a pallet assembly including a pallet and a plurality of vertically stacked rows of cases disposed on the pallet and providing an airflow pathway through the vertically stacked rows of cases;

an airflow chamber including an air inlet and an air outlet;

a fan positioned to direct air into the airflow chamber from the air inlet and exhaust air from the airflow chamber through the air outlet;

a wall disposed between the pallet receiving space and the airflow chamber, the wall having an airflow opening defining an opening periphery, the airflow opening sized and positioned to be engaged by the pallet assembly when the pallet assembly is pressed against the opening periphery; and a swing seal disposed over a portion of the airflow opening and hingedly connected to the wall about a horizontal axis, the swing seal having a movable portion at least partially protruding into the pallet receiving space in an at-rest position, such that the movable portion of the swing seal is positioned to be yieldably moved into the airflow chamber when the pallet assembly is pressed against the opening periphery, the swing seal including:

a front panel having an exterior surface facing into the pallet receiving space; and side panels disposed at respective side peripheral edges of the front panel and having a thickness, the front panel protruding into the pallet receiving space at a distance corresponding to or less than the thickness of the side panels, whereby the side panels prevent air passage past the front panel as the swing seal yieldably moves away from the at-rest position;

whereby air at a desired air temperature is induced by the fan to pass into the airflow pathway of the pallet assembly when the pallet assembly is pressed against the opening periphery and engaged with the swing seal, such that heat is transferred between the product and the air.

2. The installation of claim 1, in combination with the pallet assembly received in the pallet receiving space and sealingly engaged with the airflow opening.

3. The installation of claim 2, wherein the pallet assembly includes a spacer disposed between and abutting respective vertically stacked rows of cases, the spacer providing the airflow pathway by separating respective ones of the plurality of vertically stacked rows of cases from one another.

4. The installation of claim 2, wherein the air inlet comprises the airflow opening in the wall such that, when the pallet assembly is sealingly engaged with the airflow opening, air received through the air inlet is drawn through the airflow pathway of the pallet assembly.

5. The installation of claim 1, wherein the air inlet comprises the airflow opening in the wall.

6. The installation of claim 5, wherein the fan is disposed at the air outlet.

7. The installation of claim 1, further comprising a warehouse defining a warehouse space set to the desired air temperature and housing the pallet racking assembly, the pallet racking assembly disposed in the warehouse space.

8. The installation of claim 7, further comprising an air conditioner operably connected to the warehouse space to deliver conditioned air to the warehouse space, the conditioned air providing the desired air temperature.

9. The installation of claim 8, wherein the air conditioner comprises a chiller producing freezing air, whereby the freezing air can through the airflow pathway of the pallet assembly to thereby quickly freeze the product contained in the vertically stacked rows of cases.

10. The installation of claim 1, wherein the pallet racking assembly further comprises peripheral seals disposed about respective sides of the opening periphery and positioned to engage respective sides of the pallet assembly, the peripheral seals cooperating with the swing seal to avoid leakage of air around the sides and top of the pallet assembly to induce passage of the air at the desired air temperature primarily through the airflow pathway of the pallet assembly.

11. The installation of claim 1, wherein the wall of the pallet racking assembly comprises a first wall on a first side of the airflow chamber such that the pallet receiving space comprises a first pallet receiving space at the first side of the airflow chamber, the pallet racking assembly further comprising:

a second pallet receiving space at a second side of the airflow chamber opposite the first side, the second pallet receiving space sized and configured to receive the pallet assembly; and a second wall on the second side of the airflow chamber, the second wall disposed between the second pallet receiving space and the airflow chamber, and having a second airflow opening sized and positioned to be sealingly engaged by the pallet assembly.

12. The installation of claim 1, wherein the pallet racking assembly comprises:

a plurality of the pallet receiving spaces arranged in vertically spaced horizontal rows; and the wall includes a plurality of the airflow openings respectively disposed at each of the plurality of the pallet receiving spaces, whereby the pallet racking assembly is configured to accommodate a plurality of pallet assemblies each exposed to the air at the desired air temperature via the airflow chamber of the pallet racking assembly.

13. An installation for warehousing pallets of product, comprising:

a plurality of pallet assemblies, each pallet assembly comprising:

a pallet; and a plurality of vertically stacked rows of cases disposed on the pallet and providing an airflow pathway through the vertically stacked rows of cases containing the product; and a pallet racking assembly comprising:

a plurality of pallet receiving spaces each sized and configured to receive a respective one of the plurality of pallet assemblies along a loading direction;

an airflow chamber including an air inlet and an air outlet;

a fan positioned to direct air into the airflow chamber from the air inlet and exhaust air from the airflow chamber through the air outlet; and a wall disposed between the plurality of pallet receiving spaces and the airflow chamber, the wall having an airflow opening disposed at each of the plurality of pallet receiving spaces, each airflow opening defining an opening periphery sized to be sealingly engaged by a first portion of a respective pallet assembly;

a swing seal disposed at each airflow opening and pivotable about a horizontal axis transverse to the loading direction, the swing seal having a portion disposed within the adjacent pallet receiving space and positioned to engage an upper edge of the plurality of vertically stacked rows of cases when the pallet assembly is advanced along the loading direction into engagement with the opening periphery.

14. The installation of claim 13, further comprising a warehouse defining a warehouse space set to a desired air temperature and housing the pallet racking assembly, whereby air at the desired air temperature can pass into respective airflow pathways of the plurality of pallet assemblies to thereby simultaneously transfer heat between the product of the respective vertically stacked rows of cases and the air at the desired air temperature.

15. The installation of claim 14, further comprising an air conditioner operably connected to the warehouse space to deliver conditioned air to the warehouse space, the conditioned air providing the desired air temperature.

16. The installation of claim 15, wherein the air conditioner comprises a chiller producing freezing air, whereby the freezing air can flow through respective airflow pathways of the plurality of pallet assemblies to thereby quickly freeze the product contained in respective vertically stacked rows of cases.

17. The installation of claim 13, wherein the plurality of pallet assemblies comprises:

a first pallet assembly having a first plurality of vertically stacked rows of cases disposed in sealing engagement with a first one of the airflow openings, the first plurality of vertically stacked rows of cases having a first top edge disposed against a first one of the swing seals to rotate the first swing seal about its horizontal axis, the first swing seal cooperating with a periphery of the first airflow opening to create a first seal around the first airflow opening, a second pallet assembly having a second plurality of vertically stacked rows of cases disposed in sealing engagement with a second one of the airflow openings, the second plurality of vertically stacked rows of cases having a second top edge disposed against a second one of the swing seals to rotate the second swing seal about its horizontal axis, the second swing seal cooperating with a periphery of the second airflow opening to create a second seal around the second airflow opening, and the first pallet assembly having a first height causing the first swing seal to rotate by a first amount, and the second pallet assembly having a second height different from the first height and causing the second swing seal to rotate by a second amount different from the first amount.

18. The installation of claim 13, wherein the air inlet comprises the airflow openings in the wall.

19. The installation of claim 18, wherein the fan is disposed at the air outlet.

* * * * *